US005558490A

United States Patent [19]

Dobler et al.

[11] Patent Number: 5,558,490

[45] Date of Patent: Sep. 24, 1996

[54] LIQUID PUMP

[75] Inventors: Klaus Dobler, Gerlingen; Thanh-Hung Nguyen-Schaefer, Asperg; Michael Huebel, Gerlingen, all of Germany

[73] Assignee: Robert Bosch GmbH, Stuttgart, Germany

[21] Appl. No.: 543,119

[22] Filed: Oct. 13, 1995

[30] Foreign Application Priority Data

Dec. 24, 1994 [DE] Germany ..... 44 46 537.8

[51] Int. Cl.[6] ..... F04D 5/00

[52] U.S. Cl. ..... 415/55.1; 415/55.2

[58] Field of Search ..... 415/55.1, 55.2, 415/55.3, 55.4, 55.5

[56] References Cited

U.S. PATENT DOCUMENTS

| | | | |
|---|---|---|---|
| 5,192,184 | 3/1993 | Nobuo et al. | 415/55.1 |
| 5,310,308 | 5/1994 | Yu et al. . | |
| 5,336,045 | 8/1994 | Koyama et al. | 415/55.2 |
| 5,364,238 | 11/1994 | Yu | 415/55.1 |
| 5,391,062 | 2/1995 | Yoshioka | 415/55.1 |
| 5,464,319 | 11/1995 | Liskow | 415/55.1 |
| 5,498,124 | 3/1996 | Ito et al. | 415/55.1 |

*Primary Examiner*—John T. Kwon
*Attorney, Agent, or Firm*—Michael J. Striker

[57] ABSTRACT

In a liquid pump of the side channel type, particularly an electric fuel pump, comprising a suction cover (11) having an inlet aperture (12), an intermediate casing (13) having an outlet aperture (14), and a pump impeller (15) enclosed therebetween, and also comprising concentric side channels (21, 22) which are formed in mutually oppositely situated surfaces (111, 131) of the suction cover (11) and intermediate casing (13) and into which lead an inlet opening (12) and an outlet opening (14) respectively, the geometry of the outlet opening (14) is selected, for the purpose of reducing noise and achieving greater smoothness of running, such that its aperture wall (141) bounding the end of the side channel (22) in the intermediate casing (13) extends outward with a concave curvature, at least in the side channel region, from the inner surface (131) of the intermediate casing (13) onward, and that on the other hand the geometry of the end of the side channel in the suction cover (11) has a configuration such that the side channel (21) is given a steeply rising end flank (211).

13 Claims, 4 Drawing Sheets

LIQUID PUMP

PRIOR ART

The invention starts from a liquid pump, particularly an electric fuel pump, of the generic type defined in the preamble of claim 1.

An electrically driven fuel delivery pump of this kind, also referred to as a side channel pump, is known from U.S. Pat. No. 5,310,308. In such liquid pumps considerable noise occurs, its frequency being dependent on the speed of rotation of the pump impeller and on the speed of rotation of the blades on the pump impeller. This noise is caused mainly by pressure surges at the pump outlet aperture, which are transmitted to the pump casing via the pump impeller blades.

ADVANTAGES OF THE INVENTION

The liquid pump according to the invention, which has the characterizing features of claim 1, has in comparison therewith the advantage that through favorable geometry of the outlet aperture and of the end of the side channel in the suction cover the occurrence of dynamic pressure in the outlet aperture and in the suction cover, which is the cause of the pressure surges, is considerably reduced. Through the rounding of the outlet aperture the development of the dynamic pressure region in the outlet aperture is reduced or almost completely eliminated, and because of the steep slope of the end of the side channel the pressure surge developing at the suction cover is considerably diminished. All in all, substantially improved quiet running of the pump is achieved.

By means of the measures specified in the other claims advantageous developments and improvements of the liquid pump indicated in claim 1 are possible.

According to a preferred embodiment of the invention the side channels in the suction cover and in the intermediate casing have in each case a widening, which exceeds the radial width of the side channel, in their end regions lying axially opposite one another at the pump impeller. With this constructional configuration the small eddies still occurring are moved into the widened spaces thus formed, which are used as pressure accumulators. The amplitudes of the pressure surges are further reduced and a greater reduction of noise is achieved.

According to an advantageous embodiment of the invention the side channel in the suction cover or in the intermediate casing merges, at the end of the widened space, into a closing channel reaching as far as the end of the side channel and formed by an extended channel portion having a reduced groove depth. The groove depth of the closing channel is in this case smaller than and preferably half as great as the groove depth of the side channel. The closing channel has two groove flanks which taper to a point and whose base spacing is equal to the radial width of the side channel, while the closing channels in turn lie axially opposite one another congruently at the pump impeller. The two identical closing channels ensure that at the end of the side channel the liquid flows through continuously to the outlet aperture and that the closing process of the pump impeller is lengthened. This leads to a gentle interruption of the flow in the region of the end of the channel, whereby the amplitudes of the pressure surge are reduced or a sudden rise is avoided.

DRAWING

The invention is explained more fully in the following description with the aid of exemplary embodiments which are illustrated in the drawing, wherein:

FIG. 1 shows a longitudinal section of a schematically represented fuel pump, FIG. 2 shows a section of a part of the fuel pump of FIG. 1 in the region of the end of the side channels, the section corresponding to the sectional line VII—VII in FIG. 6, FIG. 3 shows a plan view of that side of the suction cover of the fuel pump which faces the pump impeller, in accordance with a second exemplary embodiment, FIG. 4 shows a section on the line IV—IV in FIG. 3, FIG. 5 shows a section on the line V—V in FIG. 3, FIG. 6 shows a plan view of that side of the intermediate casing of the fuel pump which faces the pump impeller in accordance with the second exemplary embodiment, FIG. 7 shows a section on the line VII—VII in FIG. 6, FIG. 8 shows a plan view of that side of the intermediate casing of the fuel pump which faces the pump impeller, in accordance with a third exemplary embodiment, FIG. 9 shows a plan view of that side of the suction cover of the fuel pump which faces the pump impeller, in accordance with the third exemplary embodiment, FIG. 10 shows a section on the line X—X in FIG. 9, FIG. 11 shows a section on the line XI—XI in FIG. 9.

DESCRIPTION OF THE EXEMPLARY EMBODIMENTS

Figure 1:
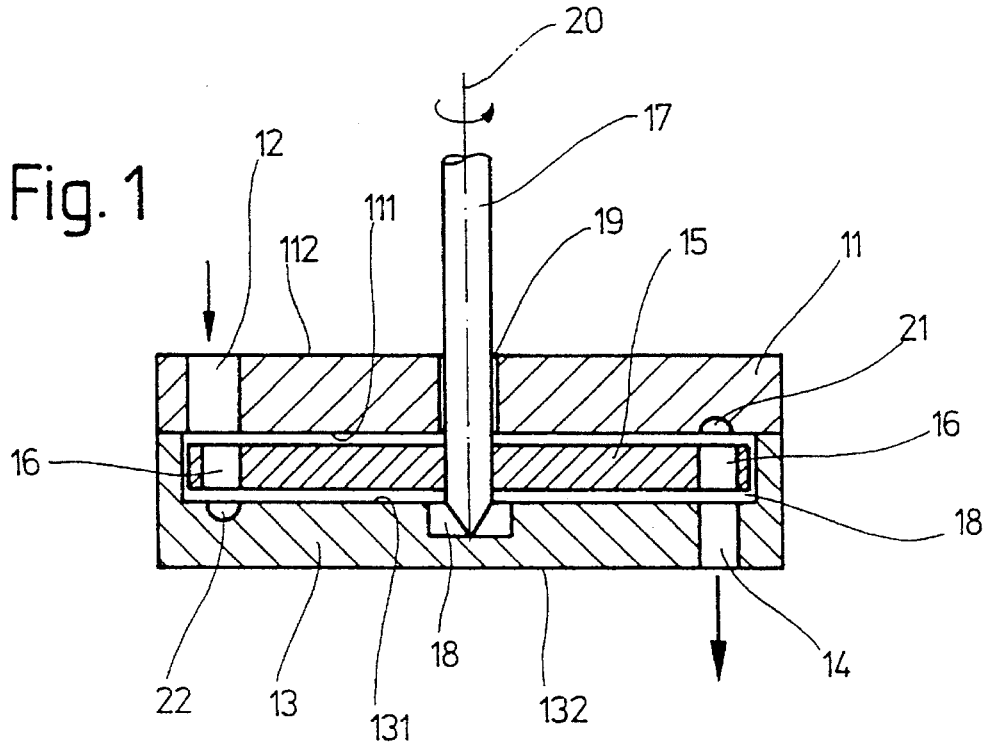

The fuel pump illustrated schematically in longitudinal section in FIG. 1, as an example of a general liquid pump, comprises a suction cover 11 having an inlet aperture 12, an intermediate casing 13 having an outlet aperture 14, and a pump impeller 15 having a plurality of blades 16 and mounted on a pump shaft 17, driven by an electric motor, for rotation therewith. The pump impeller 15 is accommodated between the suction cover 11 and the intermediate casing 13, for which purpose the latter has a coaxial circular recess 18 in which the pump impeller 15 lies. The suction cover 11 is supported on the intermediate casing 13 and closes the recess 18. The pump shaft 17 is passed liquid-tightly through a central hole 19 in the suction cover 11. The pump is in the form of a side channel pump, in which the pump chamber is formed by two side channels 21, 22 in the suction cover 11 and the intermediate casing 13 respectively. Each side channel 21 and 22 is formed by a groove which extends concentrically to the pump axis 20 and which is formed in the plane surface 111 and 131 of the suction cover 11 and intermediate casing 13 respectively, on the side facing the pump impeller 15, and extends in each case from the inlet aperture 12 to the outlet aperture 14. In FIG. 1 the inlet aperture 12 and outlet aperture 14 have been moved into the plane of the section for the sake of better representation. The side channels 21, 22 actually extend in each case over a circumferential angle of slightly more than 330°, as can be seen in FIGS. 3, 6, 8 and 9. The two side channels 21, 22 lie axially opposite one another congruently at the pump impeller 15, the inlet aperture 12 leading into the side channel 21 at the beginning of the latter and the outlet aperture 14 leading into the side channel 22 at the end of the latter.

Figure 2:
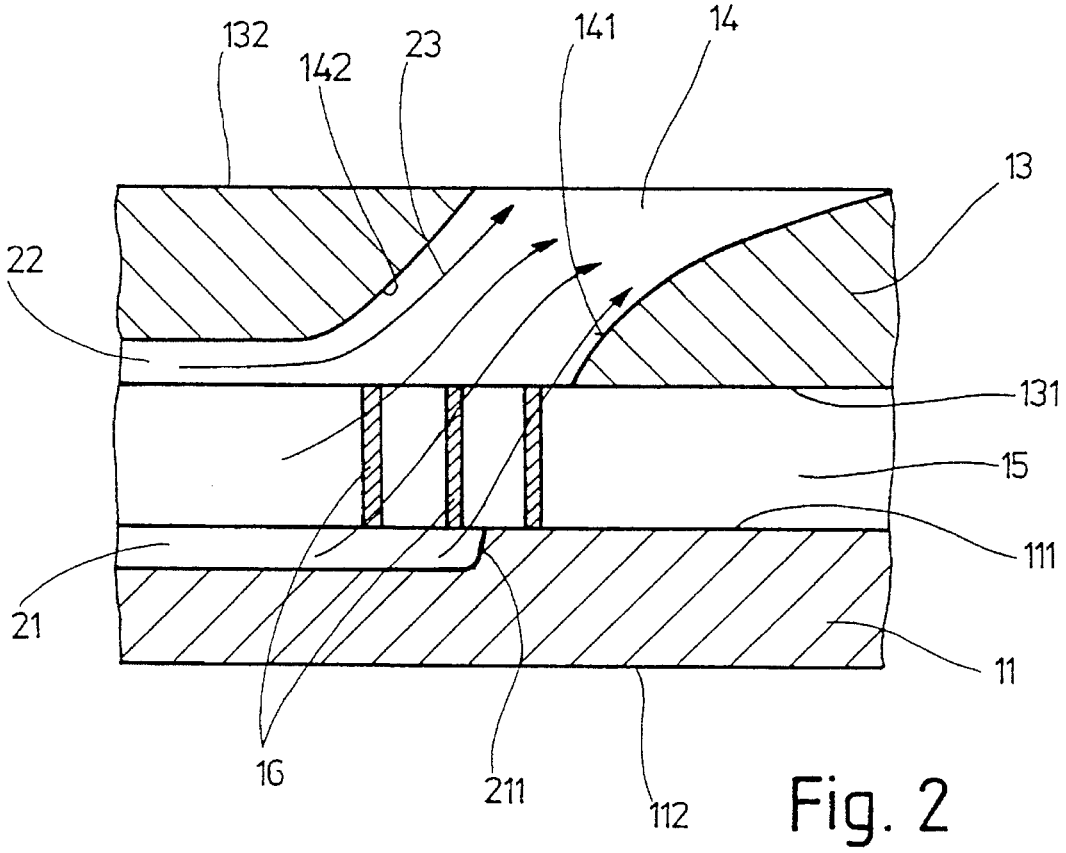
Figure 3:
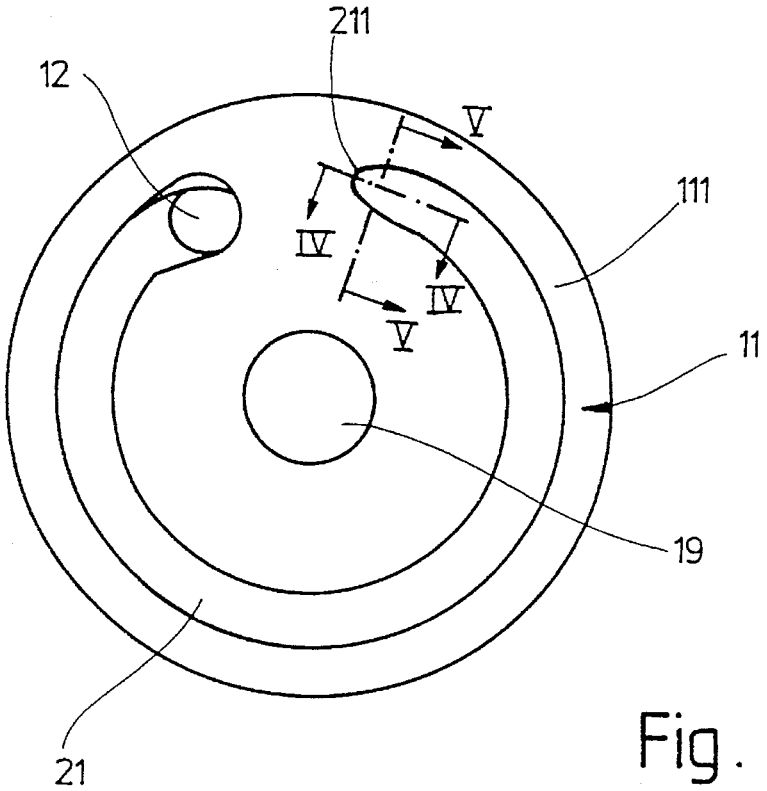
Figure 4:
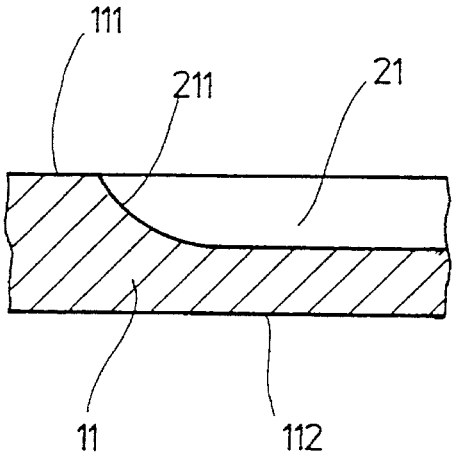
Figure 5:
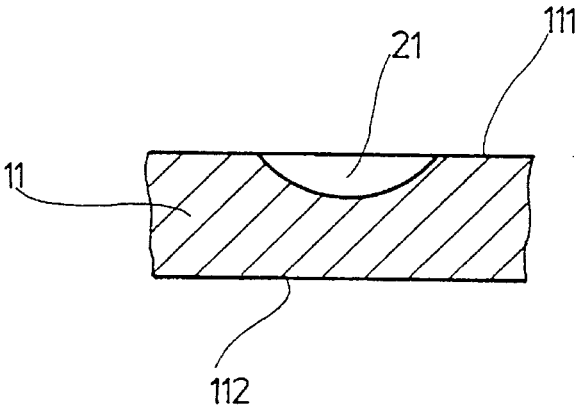

Because of a special configuration of the geometry of the side channels 21, 22 in their end region corresponding to the outlet aperture 14, and of the geometry of the outlet aperture 14, a substantial reduction of noise is achieved. This geometry is illustrated in FIG. 2, which shows a longitudinal section through the pump in the region of the outlet aperture 14, the section corresponding to the sectional line VII—VII in FIG. 6. As can be seen there, the outlet aperture 14 extends with a continuously widening aperture cross section from the bottom of the side channel 22, which is arranged in the intermediate casing 13, to the external surface 132 of the intermediate casing 13 on the side remote from the pump impeller 15. That wall 141 of the outlet aperture 14 which bounds the end of the side channel 22 has a concave curvature, at least in the side channel region from the inner surface 131, facing the pump impeller 15, of the intermediate casing 13 onwards, so that the fuel flow entering the outlet aperture 14 from the side channel 22 and from the side channel 21 encounters a rounding, so that here no pressure surge and no cylindrical eddy can occur in the outlet aperture 14. In addition, the aperture wall 142 lying opposite the aperture wall 141 and extending from the groove bottom of the side channel 22 as far as the edge of the outlet aperture is also inclined in the same direction as the aperture wall 141 and optionally also given a curved shape. Consequently, here also no eddying, which would give rise to additional noise production, can occur. The fuel flow is marked in FIG. 2 by the flow arrows 23. In addition, the side channel 21 which extends in the suction cover 11, and which in the region of the outlet aperture 14 has a blind end, is provided with an end flank 211 which rises steeply from the bottom of the side channel 21 to the inner surface 111 of the suction cover 11 on the side facing the pump impeller 15. The groove forming the side channel 21 has otherwise, as is also the case for the groove forming the side channel 22, a cross section in the shape of a segment of a circle, as can be seen for example in FIG. 5.

Figure 6:
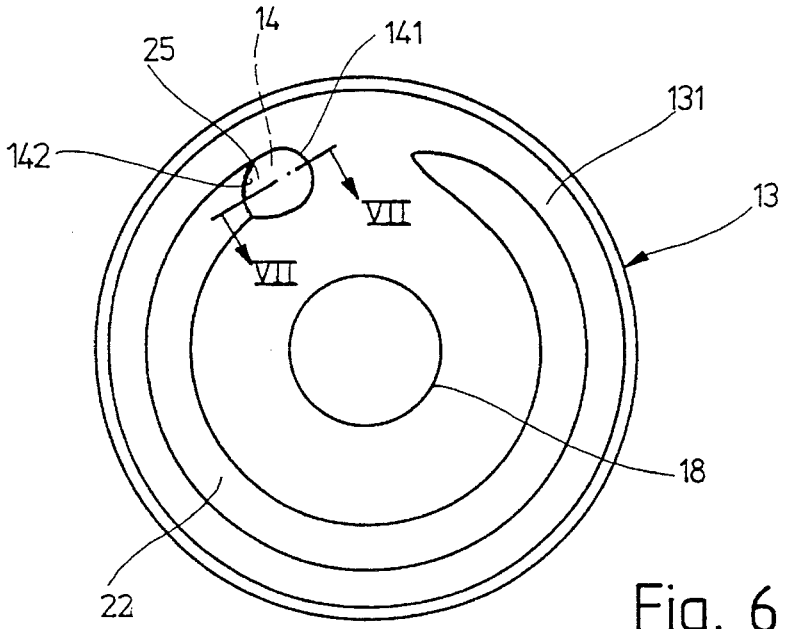
Figure 7:
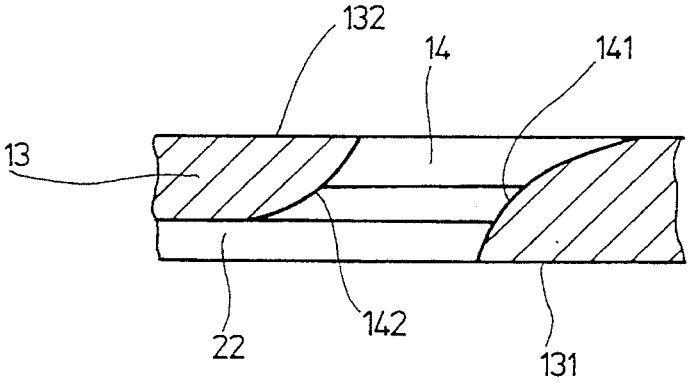
Figure 8:
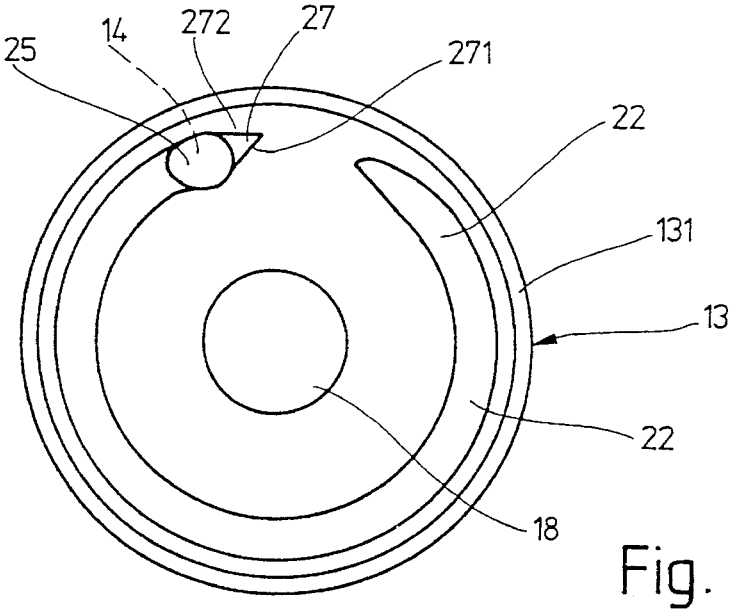
Figure 9:
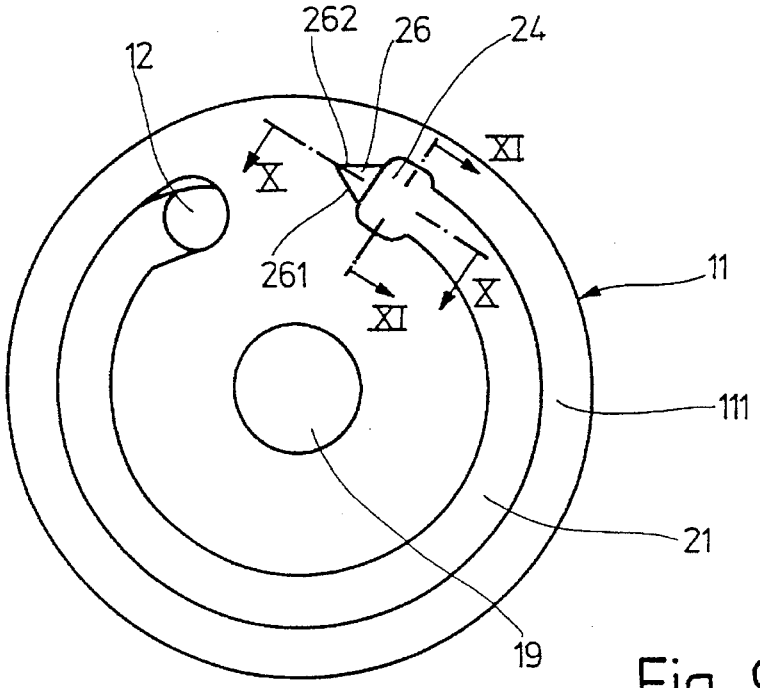
Figure 10:
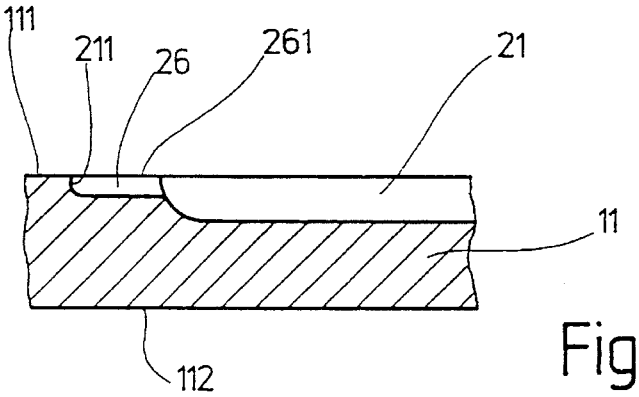
Figure 11:
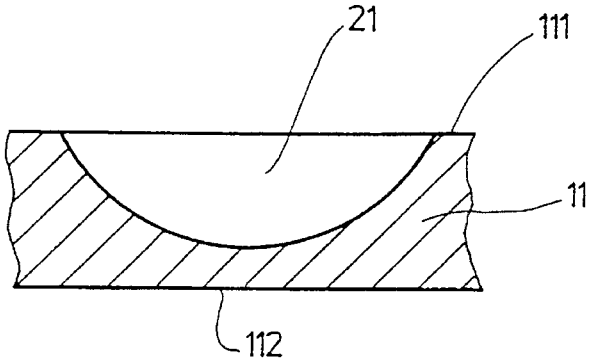

In FIGS. 3 to 7 the suction cover 11 and intermediate casing 13 of a fuel pump are shown in various views and sectional representations, in which pump the geometry of the side channels 21, 22 in the end region has been modified in relation to the previously described fuel pump, in order to achieve a still greater reduction of noise and improved smooth running of the fuel pump. As can be seen in FIG. 6, the side channel 22 in the intermediate casing 13 is provided in its end region with a widened space 25, the radial width of which is greater than that of the side channel 22, by widening the groove in the axial and radial directions. The widened space 25 in the side channel 22 extends as far as the end of the latter, into which the outlet aperture 14 leads by its aperture walls 141 and 142. This widened space 25 serves as a pressure accumulator, which leads to a reduction of pressure peaks.

In the fuel pump according to a third exemplary embodiment, which is shown in various views and sectional representations in FIGS. 8 to 11, the geometry of the closing channel ends in the region of the outlet aperture 14 is further modified in relation to the fuel pump according to the second exemplary embodiment. Here a widened space 25 (FIG. 8), as described in connection with FIG. 6, is provided in the intermediate casing 13, and in the suction cover 11 a widened space 24 (FIG. 9) having the same configuration is provided. The two widened spaces 24, 25 lie axially opposite one another at the pump impeller 15. At the end of each widened space 24 and 25 each side channel 21 and 22 in the suction cover 11 (FIG. 9) and in the intermediate casing 13 (FIG. 8) respectively merges into a closing channel 26 and 27 respectively, which extends as far as the end of the side channel. Each closing channel 26 and 27 is formed by an extension portion of the channel in which the groove depth is less than the groove depth of the side channel 21 or 22, preferably being made half as great. The closing channel 26 in the suction cover 11 is shown in longitudinal section in FIG. 10. The closing channel 27 in the intermediate casing 13 has an identical configuration. Each closing channel 26 and 27 has groove flanks 261, 262 and 271, 272 respectively, which taper to a point and whose base spacing is equal to the radial width of the side channel 21 or 22. The closing channels 26, 27 have congruent configurations and lie axially opposite one another at the pump impeller 15. These closing channels 26, 27 contribute to more extensive noise reduction in the pump, since they ensure that the fuel flows continuously at the end of the side channel to the outlet aperture 14 and that the closing operation of the pump impeller 15 is thereby lengthened. A gentle interruption of the flow in the region of the end of the channel is thereby achieved, thus leading to a marked reduction in pressure surge amplitudes.

In this fuel pump also that aperture wall 141 of the outlet aperture 14 which at the end bounds the side channel 22 and the closing channel 27 is given an arcuate curve in the manner illustrated in FIG. 2. The same applies to the other aperture wall 142 of the outlet aperture 14, which, as in FIG. 2, is inclined, optionally also in an arc. The end flank 211, bounding the flow channel 21 and the closing channel 26, of the side channel 21 in the suction cover 11 has a steep configuration (FIG. 10), as in the case of the fuel pump shown in FIG. 2.

We claim:

1. An electric fuel pump, comprising a suction cover having an inlet aperture; an intermediate casing having an outlet aperture; a rotationally driven pump impeller located between said suction power and said intermediate casing and having a plurality of blades for displacement of liquid; means forming a pump chamber and including two side channels arranged in plane surfaces of said suction cover and said intermediate casing which face said pump impeller, said side channels being formed by grooves which are concentric to a pump axis and extend from said inlet aperture to said outlet aperture, said inlet aperture leading into a beginning of said side channel arranged in said suction cover and said outlet aperture leading into an end of said side channel arranged in said intermediate casing, said outlet aperture extending with a continuously widening aperture cross-section from said side channel arranged in said intermediate casing to an outer surface of said intermediate casing on a side remote from said pump impeller, a wall of said outlet aperture which bounds an end of said side channel arranged in said intermediate casing having a concave curvature at least in a side channel region from an inner surface of said intermediate casing facing said pump impeller onward, said side channel arranged in said suction cover having a blind end in said suction cover and being provided with an end flank which rises steeply from a bottom of said side channel arranged in said suction cover to an inner surface of said suction cover on a side facing said pump impeller.

2. An electric fuel pump as defined in claim 1, wherein said outlet aperture has an aperture wall which lies opposite to said wall of said outlet aperture with said concave curvature and extends from a bottom of said side channel arranged in said intermediate casing to an edge of said outlet aperture, is inclined in direction of said opposite wall of said outlet aperture.

3. An electric fuel pump as defined in claim 2, wherein said aperture wall of said outlet aperture is inclined with a curvature.

4. An electric fuel pump as defined in claim 1, wherein at least one of said side channels has an end region provided with a widened space with a radial width greater than a radial width of a remaining portion of said at least one side channel.

5. An electric fuel pump as defined in claim 4, wherein said widened space extends to an end of said at least one side channel.

6. An electric fuel pump as defined in claim 4, wherein said widened space has an end at which said at least one side channel merges into a closing channel which reaches to an end of said at least one side channel and which is formed by an extension channel portion having a reduced groove depth.

7. An electric fuel pump as defined in claim 6, wherein said depth of said closing channel is smaller than a groove depth of said at least one side channel.

8. An electric fuel pump as defined in claim 7, wherein said depth of said closing channel is about half as great as a groove depth of said at least one side channel.

9. An electric fuel pump as defined in claim 6, wherein said closing channel has groove flanks which taper to a point and whose base spacing is approximately equal to a radial width of said at least one side channel.

10. An electric fuel pump as defined in claim 1, wherein said side channel of said intermediate casing and said side channel of said suction cover each have an end region provided with a widened space having a radial width greater than a radial width of a remaining portion of each of said side channels.

11. An electric fuel pump as defined in claim 10, wherein said widened space of each of said side channels extends to an end of a respective one of said side channels.

12. An electric fuel pump as defined in claim 10, wherein each of said widened spaces of said side channels has an end at which a respective one of said side channels merges into a closing channel which reaches to an end of a respective one of said side channels and which is formed by an extension channel portion having a reduced groove depth.

13. An electric fuel pump as defined in claim 12, wherein said closing channels have a congruent configuration and lie axially opposite one another at said pump impeller.

* * * * *